United States Patent [19]

Perisastry et al.

[11] 4,344,528

[45] Aug. 17, 1982

[54] PROJECTILE LOCK ASSEMBLY

[75] Inventors: Ayyala Perisastry, Dover; Richard A. Vishe; Peter J. Hoet, both of York, all of Pa.

[73] Assignee: Harsco Corporation, Camp Hill, Pa.

[21] Appl. No.: 200,093

[22] Filed: Oct. 23, 1980

[51] Int. Cl.[3] ..... F42B 37/00; F42B 39/00

[52] U.S. Cl. ..... 206/3; 211/89; 211/60 R; 89/1.7; 248/68 R; 414/42

[58] Field of Search ..... 206/3, 443, 446; 211/89, 60 R; 89/1.7; 248/68 R; 414/42, 47

[56] References Cited

U.S. PATENT DOCUMENTS

| | | | |
|---|---|---|---|
| 2,432,802 | 12/1947 | Reynolds . | |
| 2,525,551 | 10/1950 | Keith . | |
| 2,593,472 | 4/1952 | McGinn . | |
| 2,766,660 | 10/1956 | Laddon . | |
| 2,774,474 | 12/1956 | Phillips | 206/3 |
| 2,775,949 | 1/1957 | Hess | 206/3 |
| 2,822,730 | 2/1958 | Brennan et al. . | |
| 3,031,932 | 5/1962 | Fite, Jr. | 206/3 |
| 3,072,022 | 1/1963 | Wood et al. . | |
| 3,444,780 | 5/1969 | Fusee | 206/3 |
| 3,631,969 | 1/1972 | Lacoste et al. | 206/3 |
| 3,888,346 | 6/1975 | Lancaster | 206/3 |
| 3,998,268 | 12/1976 | Sagan . | |
| 4,099,626 | 7/1978 | Magnussen, Jr. . | |
| 4,279,339 | 7/1981 | Gotter | 206/3 |

*Primary Examiner*—Joseph Man Fu Moy

*Attorney, Agent, or Firm*—Kerkam, Stowell, Kondracki & Clarke

[57] ABSTRACT

A locking assembly is disclosed for securely holding a projectile within a cylindrical tube. The locking assembly is attached to and associated on an one-to-one basis with a particular cylindrical tube. The locking assembly includes a control rod extending parallel to the center line of the tube. The control rod rotates from an unlocked position to a locked position. In the locked position the control rod will cause a cam to move a shoe into frictionally engagement with a projectile placed in the tube. Also disclosed is a configuration for a plurality of such projectile storage cylindrical tubes and associated locking assemblies wherein the use of available space is optimized.

20 Claims, 6 Drawing Figures

PROJECTILE LOCK ASSEMBLY

BACKGROUND OF THE INVENTION

This invention relates generally to racks used for the storage and transportation of projectiles. More specifically, this invention concerns a projectile rack having locking assemblies which securely hold projectiles within a plurality of parallel horizontally disposed storage tubes.

The modern war is often a war of logistics where the winner is determined by one's ability to efficiently transport men and material. Accordingly, it is essential to optimize the conveyance of projectiles, shells and more generally ammunition.

The transportation of projectiles or shells requires a tradeoff between the two conflicting considerations of high load capacity and safety. For example, if one uses a pallet which is too heavily loaded the chances of a mishap are increased. Yet if one tries to maximize the safety factor by using a lightly loaded pallet, there is the danger that one wont't be able to deliver ammunition with the rapidity required to keep one's troops supplied.

Although the prior art has included various devices designed to safely transport an optimum number of projectiles, these systems are often of rather complex construction and prone to breaking down. For example, if a spring is used to bias a member which clamps a projectile in place, the spring may break under a great stress caused during the transportation of the projectile. That is, if the vehicle carrying the projectiles hits a bump or is otherwise subjected to a momentary shockwave, the stress on the spring may exceed its limits causing the spring to break. Obviously, the projectile will no longer be properly secured, possibly leading to dire consequences.

U.S. Pat. No. 2,432,802 to Reynolds discloses a storage rack for ammunition, including a spring biased assembly which individually locks each round of ammunition.

U.S. Pat. No. 2,822,730 to Brennan et al shows a projectile rack for securing shells in an upright position and including a series of shell holders which are spring biased towards an adjacent wall.

What has been needed is a simple, yet effective, device for adequately securing projectiles for transportation purposes, while at the same time optimizing the use of available space to provide rapid conveyance of the projectiles, thereby properly balancing load capacity and safety considerations.

SUMMARY OF THE INVENTION

Accordingly, it is an object of this invention to provide a locking assembly for securing projectiles for transportation purposes.

A further object of this invention is to provide a rack for the safe storage and transportation of projectiles, wherein a projectile can be fused without removal from the rack.

Another object of this invention is to provide for the optimum use of space in a projectile rack.

Yet another object of this invention is to accommodate various lengths of projectiles without use of spacers.

These and other objects of the invention and the attendant advantages will be readily apparent from the following description of the invention. In accordance with the present invention, a plurality of parallel cylindrical projectile storage tubes are provided. Each cylindrical tube has an associated locking assembly. The locking assembly includes a control rod extending parallel to the center line of the tube. Rotation of the control rod causes radial movement of an engagement surface which will frictionally secure the projectile within the cylindrical tube.

BRIEF DESCRIPTION OF THE DRAWINGS

Other objects and advantages of this invention will become more apparent with the following detailed description in connection with the accompanying drawings in which.

DESCRIPTION OF THE PREFERRED EMBODIMENTS

Figure 1:
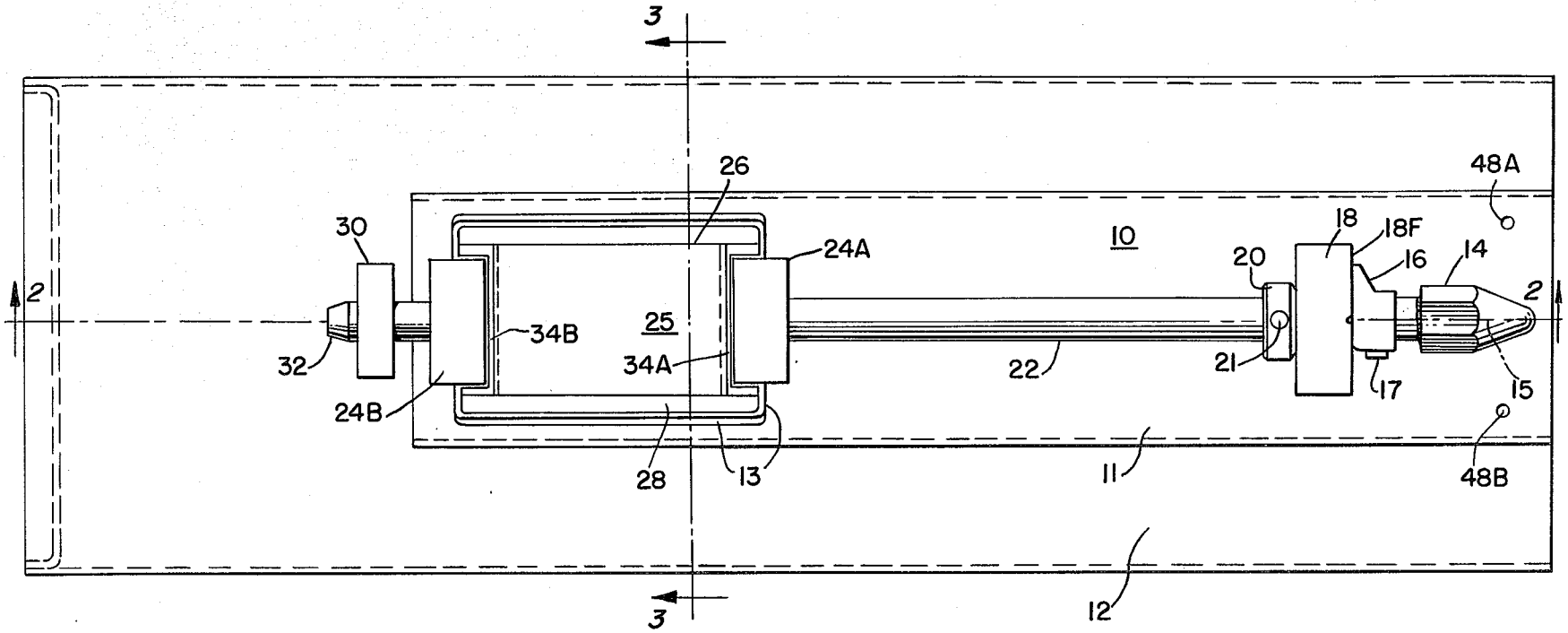
FIG. 1 shows a top view of the projectile lock assembly of the present invention.
Figure 2:
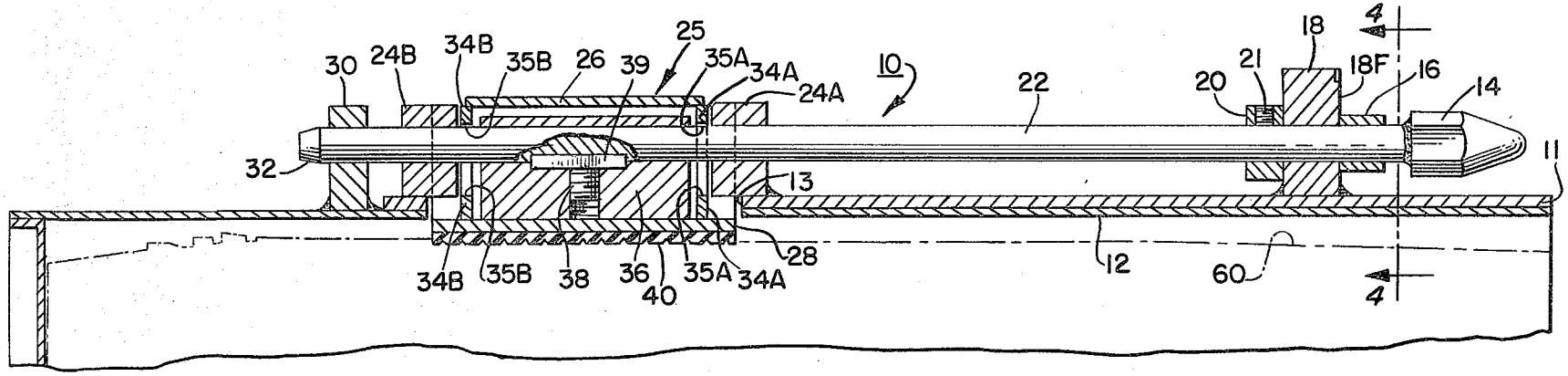
FIG. 2 is a cross-section view taken along lines 2—2 of FIG. 1.

Referring now to FIGS. 1 and 2, the projectile locking assembly 10 of the present invention is shown mounted on a cylindrical projectile storage tube 12. FIG. 1 shows a top view, whereas FIG. 2 is a cross sectional view taken along lines 2—2 of FIG. 1.

As shown in FIG. 1, lock assembly 10 includes an arcuate support plate 11, which is secured to the outside surface of cylindrical tube 12 by rivets 48A and 48B. Support plate 11, conforming to the outside surface of tube 12, extends lengthwise parallel to the center line 15 of cylindrical tube 12. Welded onto support plate 11 are lugs 18, **24*a* and 24*b*, each of which rotatably cradles the control rod 22. Control rod 22 extends parallel to the axial center line 15 of tube 12 from a tapered end 32 to a tapered nose hex handle 14. Control rod 22, which is circular in cross-section, extends through holes in the above-mentioned handle end lug 18, front shoe assembly lug 24*a* and back shoe assembly lug 24*b*. These holes are circular in cross-section, thus allowing control rod 22 to rotate along its axis relative to the lugs when a wrench is applied to handle 14. Likewise, a rear lug 30, which is welded or otherwise directly mounted to cylindrical tube 12, rotatably receives control rod 22. Rear lug 30 in conjunction with rivets 48A and 48B provide for the easy attachment and removal of support plate 11** and the associated assembly, as will be discussed in more detail below.

Support plate 11 features a cutout portion shown at 13, which is designed to accommodate shoe assembly 25 as will become apparent momentarily. Shoe assembly 25 includes a top piece 26, a shoe 28, a front side piece 34A and a rear side piece 34B. The front side piece 34A and rear side piece 34B are shaped to extend half way around lugs 24A and 24B respectively, as shown.

Adjacent the control rod handle 14 and handle end lug 18 is a pointer 16 and collar 20. Pointer 16 is fixed to control rod 22 to rotate therewith by way of set screw 17. Front face **18*f* of lug 18 includes indicia by which pointer 16 will indicate whether the control rod is in a locked or unlocked position. Collar 20 is secured to control rod 22 by way of set screw 21. Together collar 20 and pointer 16 will prevent control rod 22 from moving lengthwise relative to lug 18**.

FIG. 2 is a cross-sectional view along lines 2—2 of FIG. 1, except that the control rod 22 is not shown in cross-section. Additionally, although it should be understood that support plate 11 and cylindrical tube 12 curve both into and out of the plane used for FIG. 2, only the cross-section area of support plate 11 and cylindrical tube 12 are shown for simplicity's sake. That is, support plate 11 and cylindrical tube 12 are shown in FIG. 2 as though they were planar, it being understood that they are arcuate as will be apparent by references to FIGS. 3 and 4.

As shown in FIG. 2, control rod 22 extends lengthwise parallel to the surface of tube 12 and, center line 50 (not shown in FIG. 2) of cylindrical tube 12. Adjacent control rod handle 14 are pointer 16 and collar 20 which secure control rod 22 against axial movement, while control rod 22 is free to rotate by way of a hole in each of the four lugs 18, 24*a*, 24*b* and 30. The arrangement of pointers 16, lug 18 and collar 20 is especially advantageous in that pointer 16 serves as a collar preventing axial movement as well as functioning as an indicator.

Adjacent the shoe assembly 25 are the front and back shoe assembly lugs 24*a* and 24*b*. Each of these lugs is welded to support plate 11. As shown in FIG. 2, about half of lug 24*a* overlies support plate 11, whereas the other half of lug 24*a* overlies the aperture in support plate 11 defined by cutout edges 13. Lug 24*b* is similarly situated with about half overlying support plate 11 and half overlying the cutout defined by edges 13.

In between lugs 24*a* and 24*b* is shoe assembly 25 which includes a top piece 26, side pieces 34*a* and 34*b* and shoe 28 with rubber material 40 attached thereto. Shoe assembly 25 will ride up and down depending upon the angle of control rod 22. As shown, the shoe assembly is in a locked position with shoe 28 and rubber material 40 extending radially towards the center of the cylindrical tube. In such a position, rubber material 40 engages and clamps onto the side of a projectile (shown at ghost line 60) which would be disposed in the interior space within cylindrical tube 12. In actual practice projectile 60 would extend to an apex external to the handle (14) end of storage tube 12. Shoe assembly top piece 26 is welded to side pieces 34*a* and 34*b*, which are in turn welded to shoe 28. Both side piece 34*a* and side piece 34*b* include cutout slot portions defined by edges 35*a* and 35*b*, respectively, which allow the shoe assembly to ride up and down, depending upon the rotation of the control rod.

Shoe assembly 25 will be driven up and down by rotation of the control rod 22 acting through cam 36. As shown, cam 36 is secured to rotate with control rod 22 by set screw 36 and key 39 which is received within a corresponding keyway in control rod 22 and the cam 36. That portion of control rod 22 immediately adjacent set screw 38 and associated key 39 is shown in breakaway cross-section for illustrative purposes. Cam 36 will push pad or shoe 28 into the downward position shown in FIG. 2 when the control rod is set in a locking position. When the control rod is rotated into an unlocked position, cam 36 will push the shoe assembly 25 up by engagement with the top piece 26 of the shoe assembly 25. It should be noted that side piece cutout edges 35*a* and 35*b* are positioned such that they will not contact control rod 22 when the shoe assembly is in its lowermost position, thereby avoiding the possibility that edges 35*a* and 35*b* will bind on control rod 22. In contrast, edges 35*a* and 35*b* will touch control rod 22 when the shoe assembly 25 is in its uppermost position (unlocked), thereby helping to prevent the cam 36 from turning past the unlocked position.

Figure 3:
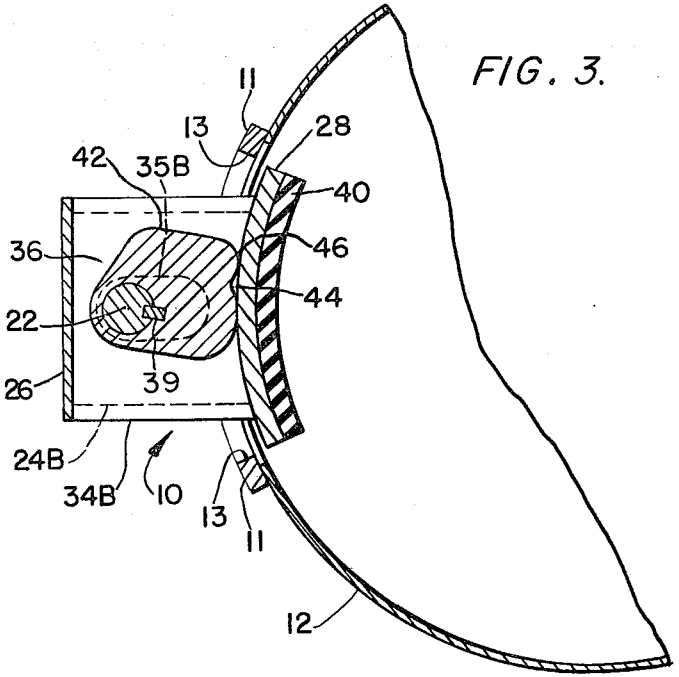
FIG. 3 shows a cross-section view taken along lines 3—3 of FIG. 1.

FIG. 3 shows a cross-sectional view taken along lines 3—3 of FIG. 1. As shown, support plate 11 is arcuate in a curve which is concentric to the circle defined by cylinder 12. Shoe 28 with rubber or elastomeric material 40 attached thereto are likewise arcuate. Shoe 28, which is shown in a locked position (radially inward), has an inner surface radius of curvature slightly larger than the radius of curvature of the projectile which is to be clamped in the cylindrical tube 12. The radius of curvature of the layer of rubber material 40 is slightly less than the radius of curvature for shoe 28 and is preferably the same as the radius of curvature of the projectile. Since the radius of curvature of the projectile will be a function of distance from the apex of the projectile, it should be appreciated that the foregoing references to the projectile's radius of curvature refer to the radius of curvature of the projectile at the place where rubber material 40 clamps onto the projectile. If desired the rubber material 40 may be slightly thicker towards the handle (14) end of shoe 28 to match any change in the projectile's radius of curvature along the length of shoe 28. However, normally this will not be necessary because shoe 28 will clamp onto the projectile at a place where the projectile has a constant or nearly constant radius of curvature.

Cam 36, which includes an unlocked portion camming surface 42, a locked portion camming surface 44 and camming stop surface 46, is attached to control rod 22 by key 39. As shown in FIG. 3, cam 36 is in a locked position whereby locked portion cam surface 44 disposes shoe 28 radially inward. To provide for positive locking, cam surface 44 preferably is curved as shown with a concave portion in between it and camming stop portion 46. This concave portion prevents cam 36 from sliding out of the locked position by the radially outward force on shoe 28, whereas cam stop surface or portion 46 prevents the cam from rotating further clockwise from the position shown in FIG. 3.

In order to change the projectile lock to an unlocked position control rod 22 is rotated one-hundred thirty degrees counterclockwise and since cam 36 is firmly attached by key 39 to control rod 22, cam 36 will also rotate 130 degrees counterclockwise from the position shown in FIG. 3. As cam 36 rotates unlocked portion camming surface 42 will push up on the underside of shoe assembly top piece 26, thus raising shoe 28. After 130 degrees rotation from the position shown in FIG. 3, cam stop surface 46 will tend to prevent any further rotation and control rod 22 will be contacted by edges 35*a* and 35*b* also helping to prevent the cam 36 from rotating past the unlocking position. Shoe 28 will then have been lifted sufficiently such that rubber material 40 is radially outward from cylindrical tube 12.

Figure 4:
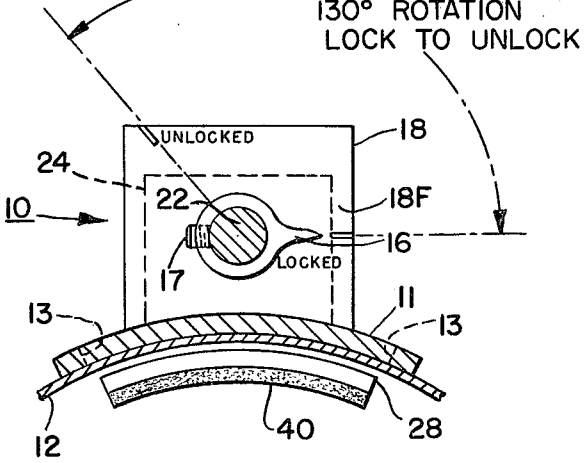
FIG. 4 shows a cross-section view taken along lines 4—4 of FIG. 2.

FIG. 4 shows a cross section view taken along lines 4—4 of FIG. 2. Once again, the locking assembly 10 is shown in a locked position with shoe 28 extending radially inward or towards the interior space of cylindrical tube 12. As discussed above, in this position rubber material 40 would secure any projectile (not shown in FIG. 4) disposed in the interior space of cylindrical tube 12. For simplicity sake, shoe assembly side piece 34*a* is not shown in FIG. 4. Lug 18, which is welded to support plate 11, includes indicia on its front face 18*f*. Pointer 16 which is secured to control rod 22 by way of set screw or lug 17, indicates whether the control rod is in a locked position as shown. If the control rod 22 were rotated 130° counterclockwise from the position shown in FIG. 4, the shoe 28 and associated rubber material 40 would be lifted radially outward, thus corresponding to an unlocked position as the pointer 16 would then indicate.

Figure 5:
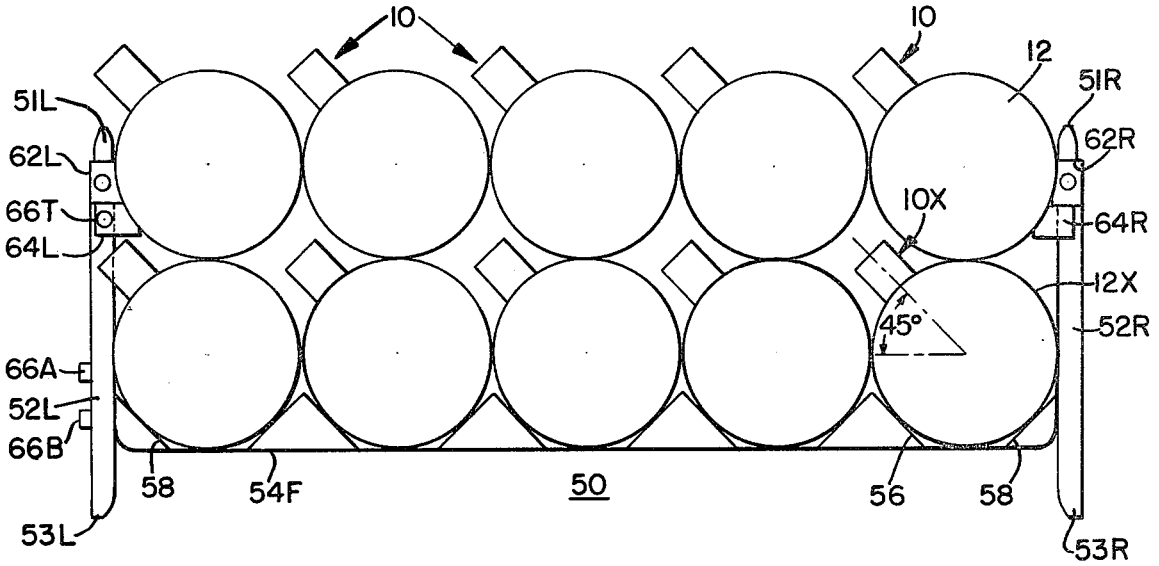
FIG. 5 shows a front view of the rack of the present invention.

Turning next to FIG. 5, a pallet assembly 50 for storing and transporting projectiles is shown. The pallet assembly 50 includes right and left front legs 52R and 52L respectively. Legs 52R and 52L each have a tapered block at their tops, 51R and 51L respectively, and a tapered portion at their bottoms, 53R and 53L respectively. The legs are channeled such that the tapered blocks 51R and 51L may be received in the channels of legs placed on top of those legs shown, thus allowing a plurality of such pallets to be stacked. A bottom front piece 54F extends between the legs 52R and 52L and is curved up at its ends. A similar bottom piece extends between the two rear legs. A plurality of cylindrical storage tubes 12 (only one being labeled for simplicity sake) are welded or otherwise adhered together and mounted on the pallet assembly. Corner pieces 58 and braces 56 (only one being labeled) are also used to secure the lower row of cylindrical tubes 12 in position. A plurality of lock assemblies 10 are schematically shown in FIG. 5 and are associated on a one to one basis with each one of the cylindrical tubes 12. Lifting eyes 62R and 62L are welded to the far right and far left top row tubes respectively and allow for convenient lifting of the pallet by cranes or similar machines. Similar lifting eyes are mounted on the rear of those same two tubes.

As shown the cylindrical tubes 12 are arranged in parallel fashion with five cylindrical tubes on a top horizontal row and 5 cylindrical tubes on a bottom horizontal row. Each of the bottom cylindrical tubes is directly beneath a corresponding top cylindrical tube. Each locking assembly 10 is located radially and obliquely outward from the center of the corresponding cylindrical tube and at a 45° angle with respect to the horizontal as shown by cylindrical tube 12*x* and associated with lock assembly 10*x*, thereby avoiding any interference between a lock assembly and any adjacent tube.

The legs 52R and 52L are channeled along their length to facilitate stacking of pallets, as mentioned above. Additionally, there are two rear legs 52RR and 52LR not shown in FIG. 5. All four of the legs 52R, 52L, 52RR and 52LR are attached to the assembly in the same manner with the exception of front left leg 52L, which is removable by way of bolts 66A, 66B and 66T.

Figure 6:
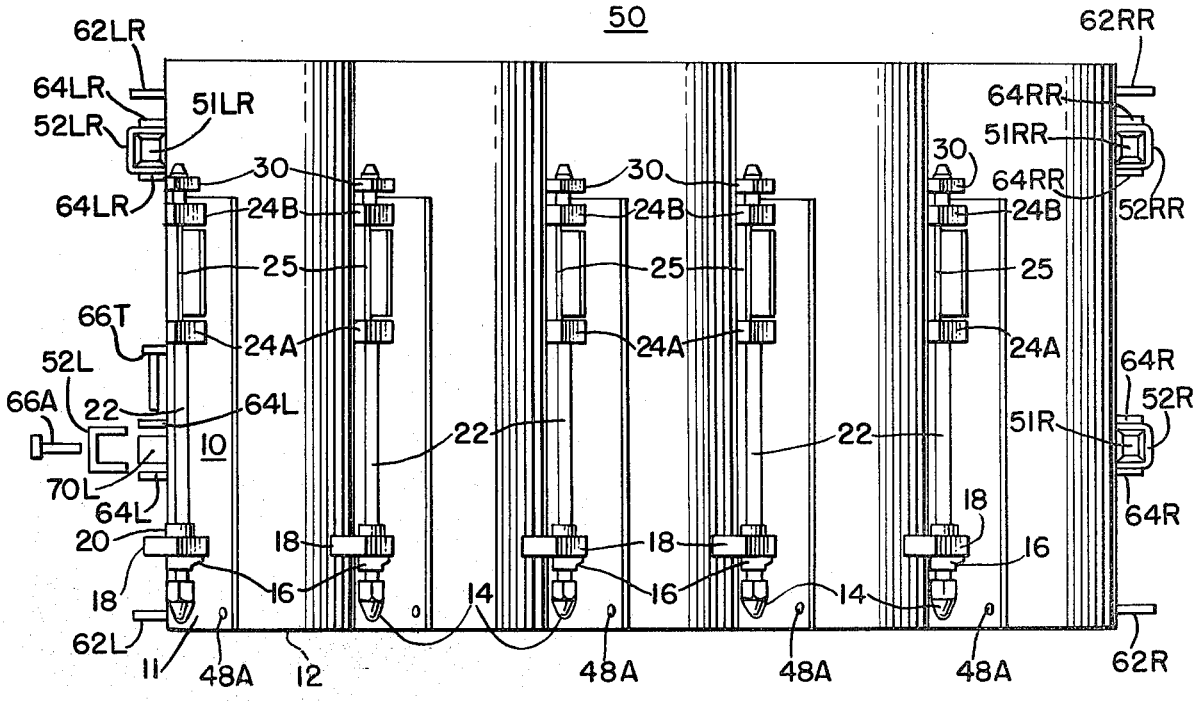
FIG. 6 shows a top view of the rack of the present invention.

The front left leg 52L must be removable in order to remove the lower left lock assembly 10 for adjustments or inspections. The necessity of removing leg 52L prior to removal of the lower left lock assembly will be more apparent later when FIG. 6 is considered. However, it should be noted that each lock assembly 10 could as well be positioned at a 45° angle to the right of its associated cylindrical tube 12, instead of to the left as FIG. 5 depicts. If each lock assembly was mounted on the right of its associated tube, then the front right leg 52R would be removable, instead of front left leg 52L.

FIG. 6 shows a top view of the pallet assembly of FIG. 5 wherein the lock assemblies 10 are illustrated instead of just shown schematically. Additionally, the removable leg 52L is shown removed so as to more aptly illustrate how it is connected to the assembly.

In order to remove a lock assembly 10 for adjustment one initially places it in on unlocked state. In an unlocked state rubber material 40 will preferably be slightly radially outside cylindrical tube 12 (refer momentarily back to FIG. 2). One may then remove rivets 48A and 48B (FIG. 1) whereupon support plate 11 and the associated structure may simply be slid forward with control rod 22 sliding out of lug 30 (which is welded to tube 12). Thus, in the usual case the projectile lock assembly is easily removable. However, referring back to FIG. 5 and FIG. 6, the lugs 24A and 24B of the lower left most lock assembly 10 will not be able to clear left front leg 52L. For this reason leg 52L is made easily removable.

The mounting of the legs will be discussed with reference to FIGS. 5 and 6. Considering for example the removable left front leg 52L, which leg is shown exploded, the leg itself has a channel running lengthwise. The channel receives a block 70L which is mounted by welding onto the left upturned end of bottom piece 54F. Attached to the top left most tube 12 are two lugs, both labeled 64L. A bolt 66T and associated nut (not shown) secures the upper part of channeled leg 52L in between lugs 64L, whereas 2 bolts 66A and 66B secure the lower part of leg 52L to the block 70L. Not shown in FIG. 6 is a chamfered block 51L, which would be welded or otherwise attached in the top of the channel of leg 52L. As discussed above, this block 51L would extend into a channel on a leg of a pallet stacked above the pallet in question. The other three legs 52R, 52RR and 52LR are structured essentially the same way with the absence of bolts 66A, 66B and 66T, since each of these legs may be welded or permanently attached to block 70 and lugs 64. Lifting eyes 62L, 62LR, 62R and 62RR may be attached near the 4 corners of the assembly as shown in FIG. 6.

Although a specific embodiment of the present invention is disclosed, it is to be appreciated that the specifics are given for illustrative purposes only. Accordingly, the scope of the present invention should be determined with reference to the appended claims.

We claim:

1. A locking assembly for securely holding an elongated article within an associated cylindrical tube comprising:

a cylindrical tube defining an interior space and an axial center line;

a control rod extending lengthwise parallel to the center line of said cylindrical tube and selectively rotatably disposable in a locked position and an unlocked position;

a shoe assembly including an engagement surface;

and a camming surface cooperating with said control rod and said shoe assembly; whereby rotation of said control rod to a locked position moves said engagement surface of said shoe assembly towards said interior space, said engagement surface thereby serving to clamp and frictionally secure one of said elongated articles whenever such article is disposed within said cylindrical tube.

2. The apparatus of claim 1 wherein said camming surface includes an unlocking portion and a locking portion, and the unlocking portion is operative upon rotation of the control rod to an unlocked position to move said engagement surface away from said interior space, and the locking portion is operative upon rotation of the control rod to a locked position to move said engagement surface towards said interior space.

3. The apparatus of claim 1 wherein said control rod is external to said interior space of said cylindrical tube.

4. The apparatus of claim 1 wherein said engagement surface is made of resilient material and is curved inward towards said interior space.

5. The apparatus of claim 1 wherein said control rod is mounted on a plurality of lugs which allow said control rod to be rotated about a control rod axis.

6. The apparatus of claim 1 wherein the locking assembly is for securing a single projectile.

7. The apparatus of claim 6 wherein said control rod is external to said interior space of said cylindrical tube and said control rod is mounted on a plurality of lugs which allow said control rod to be rotated about a control rod axis.

8. The apparatus of claim 7 wherein said camming surface cooperates with said control rod to rotate at least partially about said control rod axis, said camming surface is part of a cam secured to said control rod and the engagement surface is curved to allow secure contract with a curved surface of said projectile.

9. The apparatus of claim 6 wherein said shoe assembly includes a top piece and a shoe, and said engagement surface is attached to said shoe, said camming surface includes an unlocking portion and a locking portion and said shoe assembly moves towards said interior space and away from said interior space dependent upon the rotation of said control rod, said camming surface locking portion engages said shoe to move said shoe assembly towards said interior space and said camming surface unlocking portion engages said top piece to move said shoe assembly away from said interior space.

10. The apparatus of claim 9 wherein said camming surface cooperates with said control rod to rotate at least partially about said control rod axis, and said control rod is rotatably supported by a plurality of lugs external to said interior space of said cylindrical tube, said engagement surface is resilient, and said plurality of lugs includes a lug directly attached to said cylindrical tube, and a handle end lug and a shoe assembly lug, said handle end lug and said shoe assembly lug mounted on an arcuate support plate, said support plate conforming and attached to the outside surface of said cylindrical tube, said support plate having a cutout portion which overlies a corresponding cutout portion on said cylindrical tube, said shoe moving towards said interior space and away from said interior space through said cutout portions, and said shoe assembly further includes two side pieces which connect the top piece to the shoe, each of the side pieces having a hole such that the control rod extends through the hole without contacting the side piece, and said handle end lug includes a front face having indicia which are selectively pointed to by a pointer attached to said control rod, said indicia indicating whether the control rod and shoe assembly are in a locked position or an unlocked position.

11. An apparatus for securely transporting or storing projectiles comprising:

a plurality of cylindrical tubes, each cylindrical tube having an interior space and defining an associated axial center line, said cylindrical tubes and associated axial center lines arranged in parallel, a plurality of lock assemblies, each one of said lock assemblies capable of independently securing a projectile within an associated cylindrical tube, each of said lock assemblies attached to and associated on a one-to-one basis with a particular one of said tubes, each lock assembly including a control rod extending lengthwise along the associated tube and selectively disposable in a locked position and an unlocked position, and each lock assembly obliquely positioned relative to the associated cylindrical tube and including a portion external to the associated cylindrical tube.

12. The apparatus of claim 11 wherein each control rod is external to the associated cylindrical tube and each control rod has a control rod axis parallel to the axial center line of the associated tube, each control rod rotating about its control rod axis to selectively dispose its lock assembly in a locked position and an unlocked position.

13. The apparatus of claim 12 wherein each of said lock assemblies includes a shoe assembly having an engagement surface which operates to clamp and secure a projectile within the associated cylindrical tube when said lock assembly is in a locked position.

14. The apparatus of claim 13 wherein the cylindrical tubes are arranged in at least an upper row and a lower row and the axial center line of each cylindrical tube on the top row is directly over an axial center line of a cylindrical tube on the lower row so as to uniquely define a vertical plane.

15. The apparatus of claim 14 wherein each of said lock assemblies further includes a camming surface which cooperates with said control rod and said shoe assembly whereby rotation of said control rod selectively moves said shoe assembly towards the interior space of the associated cylindrical tube and away from the interior space of the associated cylindrical tube.

16. The apparatus of claim 15 wherein each camming surface provides an overcenter toggle position for securely locking a projectile within each one of the cylindrical tubes.

17. The apparatus of claim 15 wherein each one of the lock assemblies is positioned at 45° from a horizontal radius extending outward from the axial center line of the associated cylindrical tube.

18. The apparatus of claim 15 wherein each one of said cylindrical tubes includes a hole through which a shoe of said shoe assembly moves and the engagement surface is made of resilient material attached to said shoe.

19. The apparatus of claim 18 wherein each control rod has a handle end and each locking assembly includes a handle end lug, a shoe assembly lug and a rear lug, and said control rod secured in position by said lugs.

20. The apparatus of claim 19 wherein each rear lug is mounted directly on the associated cylindrical tube, and each of said shoe assembly lugs and said handle end lugs are mounted on an arcuate support plate which is conformingly attached to the outside surface of the associated cylindrical tube.

* * * * *